US008608335B2

(12) United States Patent
Rooms et al.

(10) Patent No.: US 8,608,335 B2
(45) Date of Patent: Dec. 17, 2013

(54) LIGHTING APPARATUS WITH A BOOST

(71) Applicant: LSI Industries, Inc., Cincinnati, OH (US)

(72) Inventors: Rob Allen Rooms, Miamiville, OH (US); John D. Boyer, Lebanon, OH (US)

(73) Assignee: LSI Industries, Inc., Cincinnati, OH (US)

( * ) Notice: Subject to any disclaimer, the term of this patent is extended or adjusted under 35 U.S.C. 154(b) by 0 days.

(21) Appl. No.: 13/754,601

(22) Filed: Jan. 30, 2013

(65) Prior Publication Data

US 2013/0141898 A1 Jun. 6, 2013

Related U.S. Application Data

(63) Continuation of application No. 12/900,811, filed on Oct. 8, 2010, now Pat. No. 8,388,166, which is a continuation-in-part of application No. 12/254,107, filed on Oct. 20, 2008, now Pat. No. 7,972,035.

(60) Provisional application No. 60/982,240, filed on Oct. 24, 2007.

(51) Int. Cl.
*F21S 8/02* (2006.01)
*F21V 23/00* (2006.01)

(52) U.S. Cl.
USPC ..... 362/147; 362/362; 362/364

(58) Field of Classification Search
USPC ..... 362/147, 364, 362, 365; 137/234.6; 336/67; 361/674, 825
See application file for complete search history.

(56) References Cited

U.S. PATENT DOCUMENTS

| | | | | |
|---|---|---|---|---|
| 3,851,225 | A * | 11/1974 | Luchetta | 361/674 |
| 4,901,748 | A * | 2/1990 | Shotmeyer | 137/234.6 |
| 5,440,471 | A | 8/1995 | Zadeh | |
| 5,746,503 | A * | 5/1998 | Hillstrom et al. | 362/248 |
| 5,927,843 | A * | 7/1999 | Haugaard et al. | 362/147 |
| 6,231,214 | B1 | 5/2001 | Haugaard | |
| 6,367,945 | B2 * | 4/2002 | Quiogue et al. | 362/147 |
| 6,497,499 | B1 * | 12/2002 | Fischer et al. | 362/265 |
| 6,700,112 | B2 * | 3/2004 | Brown | 250/216 |
| 6,799,982 | B2 * | 10/2004 | Kerr, Jr. | 439/180 |

(Continued)

FOREIGN PATENT DOCUMENTS

| | | |
|---|---|---|
| CN | 101737689 | 6/2010 |
| CN | 101836042 | 9/2010 |

(Continued)

OTHER PUBLICATIONS

International Search Report and the Written Opinion from Corresponding PCT/US2011/052299 dated Jan. 16, 2012.

(Continued)

*Primary Examiner* — Peggy A. Neils
(74) *Attorney, Agent, or Firm* — McDermott Will & Emery, LLP

(57) ABSTRACT

Lighting apparatus and structures are described to space electrical drivers from a light panel. In this way, a driver box housing the driver can be spaced from the light panel to communicate with pre-existing facilities (e.g. electrical wiring) and can serve the additional advantage of keeping the driver box out of standing water that may accumulate on the structure.

42 Claims, 7 Drawing Sheets

(56) References Cited

U.S. PATENT DOCUMENTS

| | | | | |
|---|---|---|---|---|
| 7,559,674 | B2 | 7/2009 | He et al. | |
| 7,614,769 | B2 | 11/2009 | Sell | |
| 7,771,085 | B2 | 8/2010 | Kim | |
| 7,954,975 | B2 | 6/2011 | Zhou | |
| 7,959,332 | B2 | 6/2011 | Tickner et al. | |
| 7,993,037 | B1 * | 8/2011 | Buse | 362/365 |
| 8,042,973 | B2 | 10/2011 | Inoue et al. | |
| 8,152,334 | B2 | 4/2012 | Krogman | |
| 8,176,931 | B1 * | 5/2012 | Cajiga et al. | 137/234.6 |
| 8,186,855 | B2 | 5/2012 | Wassel et al. | |
| 8,480,268 | B2 * | 7/2013 | Wilson et al. | 362/365 |
| 8,519,266 | B2 * | 8/2013 | Sartini | 174/61 |
| 2007/0279906 | A1 | 12/2007 | He | |
| 2008/0170398 | A1 * | 7/2008 | Kim | 362/260 |
| 2009/0135608 | A1 | 5/2009 | Sell | |
| 2010/0038657 | A1 | 2/2010 | Higuchi | |
| 2010/0061097 | A1 | 3/2010 | Krogman | |
| 2010/0128491 | A1 | 5/2010 | Hashimoto et al. | |
| 2010/0188845 | A1 | 7/2010 | Rooms | |
| 2010/0246172 | A1 | 9/2010 | Liu | |

FOREIGN PATENT DOCUMENTS

| | | |
|---|---|---|
| CN | 101846276 | 9/2010 |
| EP | 2213932 | 8/2010 |
| TW | M291493 | 6/2006 |

OTHER PUBLICATIONS

English Version of Search Report dated May 13, 2013 from Corresponding Taiwan Patent Application No. 100135414.

* cited by examiner

LIGHTING APPARATUS WITH A BOOST

RELATED APPLICATIONS

This application is a continuation of U.S. patent application Ser. No. 12/900,811 filed Oct. 8, 2010, now allowed, which is a continuation-in-part of U.S. patent application Ser. No. 12/254,107, filed Oct. 20, 2008 and entitled "Adjustable Lighting Apparatus," which claims priority to U.S. Provisional Patent Application No. 60/982,240, filed Oct. 24, 2007; the entire contents of both of which application are incorporated herein by reference.

BACKGROUND

Light panels, sometimes referred to as "luminaires," are typically designed to provide a downward and outward distribution of light for many applications, including exterior illumination of gasoline service stations, convenience stores and drive-through restaurants, for example. Canopy luminaires typically include a box-like canopy fixture housing mounted to a horizontal ceiling or canopy support structure for enclosing and supporting lighting components and related structure of the canopy luminaire. The lighting components of the canopy luminaire include electrical control elements, such as ballasts, capacitors, and ignitors, which are electrically coupled to a high intensity discharge (HID) lamp. The lamp is typically mounted horizontally in a lamp socket within the canopy fixture, and a reflector is provided above the light-emitting section of the lamp to distribute light downwardly through a glass or plastic lens assembly which encloses the lamp.

Replacement or conversion of canopy luminaires generally requires several or all of the existing lighting components and related structure of the luminaire to be removed from the existing canopy fixture housing to provide sufficient room in the fixture housing for installation of the replacement luminaire. In the past, replacement canopy luminaires have been shipped from the manufacturer as disassembled components which are then individually mounted and wired in the canopy fixture housing. It will be appreciated, however, that installation and wiring of the separate retrofit luminaire components in an existing canopy fixture installation is a complicated and time consuming process as the canopy fixture is generally only accessible by ladder. As any location or site may require replacement or conversion of ten or more canopy luminaires, the difficulty associated with installing, mounting, and wiring separate retrofit components of the existing canopy luminaires is significantly increased.

Thus, traditional luminaire assemblies are complicated and cumbersome to retrofit into an existing canopy luminaire or other canopy fixture housing.

SUMMARY

It is to be understood that both this summary of the present disclosure and the following detailed description are exemplary and explanatory and are not intended to limit the scope of the present disclosure. Moreover, with regard to terminology used herein, a reference to an element in the singular is not intended to mean "one and only one" unless specifically stated, but rather "one or more." The term "some" refers to one or more. Underlined and/or italicized headings and subheadings are used for convenience only, do not limit the present disclosure, and are not referred to in connection with the interpretation of the description of the present disclosure.

Aspects and embodiments of the present disclosure address problems previously described by providing lighting apparatus that are adapted for installation to facilitate situating a driver box of the apparatus adjacent to pre-existing facilities, such as electrical power. The lighting apparatus can be, in one embodiment, configured for installation into a pre-existing mount having facilities configured for a pre-existing lighting apparatus. In another embodiment, the lighting apparatus can comprise a driver box for driving one or more light sources of the apparatus and the driver box being situated to accommodate the facilities previously installed for a pre-existing lighting apparatus. In one example, this embodiment may include providing a diver box for driving light emitting diodes (LEDs) within lighting apparatus situated (e.g. elevated) to accommodate facilities of a pre-existing high-intensity discharge D apparatus, or other types of lighting.

For example, in one an aspect of the present disclosure, a lighting apparatus is configured for installation in a canopy having a pre-existing electrical supply line elevated above the opening in the canopy. The lighting apparatus can include a boost between a light panel and a driver box to elevate the driver box to accommodate the elevation of the elevated electrical supply line.

In another aspect of the present disclosure a lighting apparatus for installation into a structure, such as a canopy, and can comprise a driver box for driving one or more light sources of the lighting apparatus, with the driver box being spaced from the light sources and from the structure so as to separate the driver box from the structure. When the structure is a canopy, the spacing of the driver box elevates the driver box from the uppermost surface of the canopy where water (e.g. rain water) can accumulate and thus keeps the driver box out of pooling water.

A further aspect of the present disclosure is directed to a method of installing a lighting apparatus in an existing fixture having a housing with an inwardly directed flange at a lower end thereof surrounding and defining an opening in the fixture housing, the fixture housing further having a ballast coupled to a power source through a first set of electrical leads, a first lamp socket coupled to the ballast through a second set of electrical leads, a lamp mounted in the first lamp socket, a reflector and a lens assembly covering the opening. The method can include removing the lens assembly from the fixture housing to expose the interior of the housing through the opening therein. The first set of electrical leads coupled to the ballast can be disconnected. The lamp and the reflector can be removed from the fixture housing. A mounting plate can be provided that includes an upper surface and a lower surface, an outer perimeter, and an aperture defined by an inner perimeter. The mounting plate can be adapted to fit against and be connected to the flange of the housing. A light panel can be provided that includes a lighting unit or luminaire. Both a power control unit and a boost can be inserted through the aperture, where the power control unit operates the lighting unit and is electrically coupled to the lighting unit and the boost is between the power control unit and the light panel and is configured to support the power control unit through the aperture for permitting the coupling of the lighting power unit to an electrical cable present in the housing.

A further aspect of the invention comprises a lighting apparatus for installation in at opening in a structure having facilities elevated above the opening, the apparatus comprising: a light panel including one or more light sources; a driver box for housing a driver to be electrically coupled to the one or more light sources; and a boost between the light panel and the driver box and configured to space the driver box from the light panel. The facilities may be electrical supply wiring. The structure may be a canopy. The boost may facilitate placing the driver box in electrical communication with facilities. The boost may facilitate placing the driver box in electrical communication with facilities previously installed for communication with a different lighting apparatus. At least one of the one or more light sources may comprise an LED. At least one dimension of the boost may be adjustable.

Yet a further aspect of the invention comprises a method of installing a lighting apparatus in an existing structure with an opening defined therein and existing facilities, the lighting apparatus comprising a light panel including one or more light sources, a driver box for housing a driver to be electrically coupled to the one or more light sources, a boost, the method comprising: a) identifying a distance that the driver box need be spaced from the light panel to communicate with the existing facilities; and b) adjusting the size of the boost to facilitate space the driver box the distance from the light panel. The boost may be secured to the light panel. The boost may be secured to the driver box. The facilities may be electrical wiring. The driver box may be connected to the facilities. The structure may be a canopy. At least one of the one or more light sources may comprise an LED and the driver box may house a driver to power the LEDs. The facilities may comprise electrical wiring in an electrical conduit and the size of the boost may be adjusted by cutting the boost so as to be properly sized to space the driver box the distance from the light panel.

An additional aspect of the invention comprises a lighting apparatus for installation in a structure, the apparatus comprising: a light panel including one or more light sources; a driver box for housing a electrical elements for channeling electricity to the light sources; and a boost between the light panel and the driver box, spacing the driver box from the light panel such that the driver box is spaced from an upper surface of the structure. The structure may be a canopy. At least one of the one or more light sources may comprise an LED. The lighting apparatus may comprise a mounting plate.

It will be appreciated that the foregoing embodiments and aspects can be combined or arranged in any practical combinations. Other features of embodiments of the present disclosure will be apparent from the description, the drawings, and the claims herein.

BRIEF DESCRIPTION OF THE DRAWINGS

Aspects of the disclosure may be more fully understood from the following description when read together with the accompanying drawings, which are to be regarded as illustrative in nature, and not as limiting. The drawings are not necessarily to scale, emphasis instead being placed on the principles of the disclosure. In the drawings.

Figure 1:
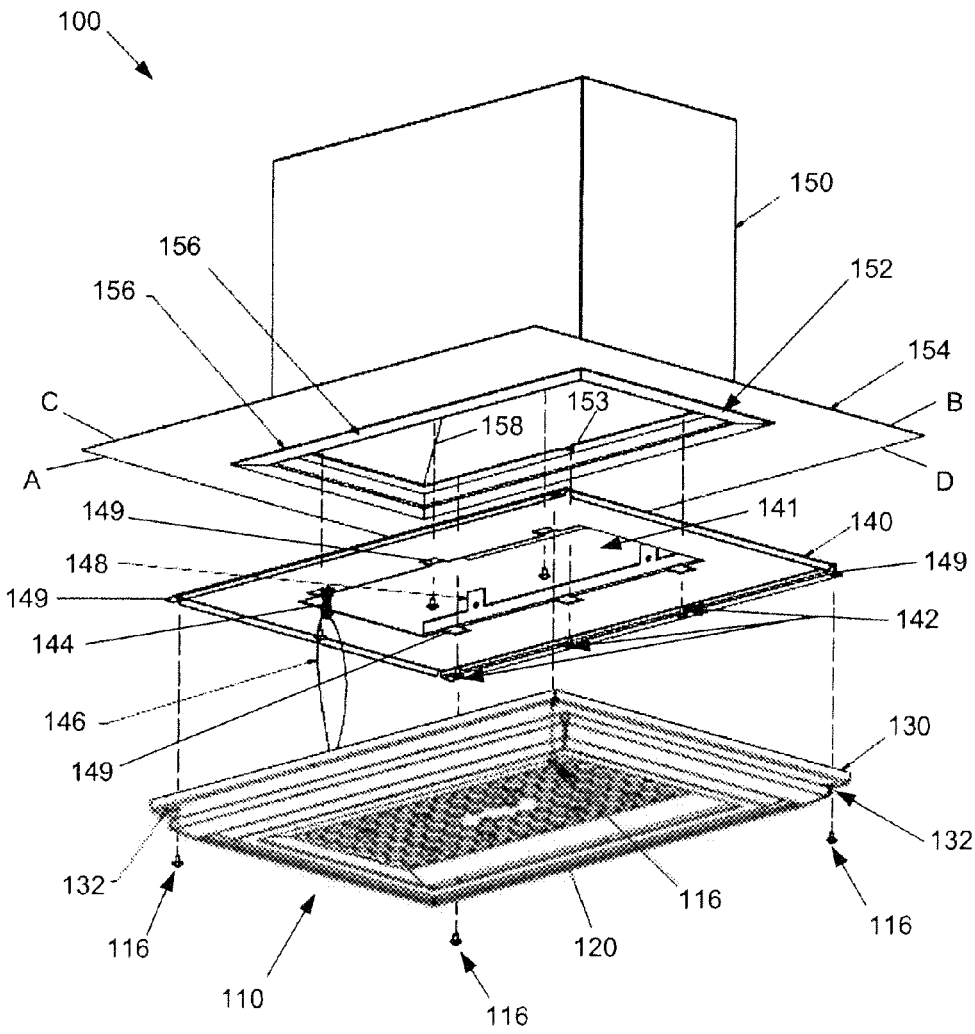
FIG. 1 is an exploded view of one embodiment of a lighting apparatus, in accordance with exemplary embodiments of the present disclosure.

While certain embodiments are depicted in the drawings, one skilled in the art will appreciate that the embodiments depicted are illustrative and that variations of those shown, as well as other embodiments described herein, may be envisioned and practiced within the scope of the present disclosure. Accordingly, the drawings and detailed description are to be regarded as illustrative in nature and not as restrictive.

DETAILED DESCRIPTION

In the following detailed description, numerous specific details are set forth to provide a full understanding of aspects and embodiments of the present disclosure. It will be apparent, however, to one ordinarily skilled in the art that aspects and embodiments of the present disclosure may be practiced without some of these specific details. In other instances, well-known structures and techniques have not been shown in detail to for ease in comprehension.

Embodiments of the present disclosure are directed to lighting apparatus that are adapted for installation in housings. The housings can be pre-existing ones, such as those installed for high-intensity discharge (HID) or for other types of lighting. The lighting apparatus can include a light unit (e.g., luminaire) with desired type of light source(s), for example, an array of LEDs. The apparatus can include structures that are adapted for use with the housings such that installation of a light unit requires a minimum of user effort and time. Such lighting apparatus, and related installation methods, can accordingly provide for the installation and use of high-efficiency lighting.

FIG. 1 depicts an exploded view of a lighting apparatus 100, in accordance with exemplary embodiments of the present disclosure. The lighting apparatus 100 includes a light panel (or luminaire) 110 that includes one or more light sources, an external mounting plate 130, and an internal mounting panel or "connector plate" 140 that is adapted to fit a housing 150. The light panel 110 can include a lighting unit 120 that includes a number of light sources, e.g., an array of commercially available LEDs, as well as an optional optic (not shown) for protecting the light sources and/or directing/focusing optical output.

Figure 6:
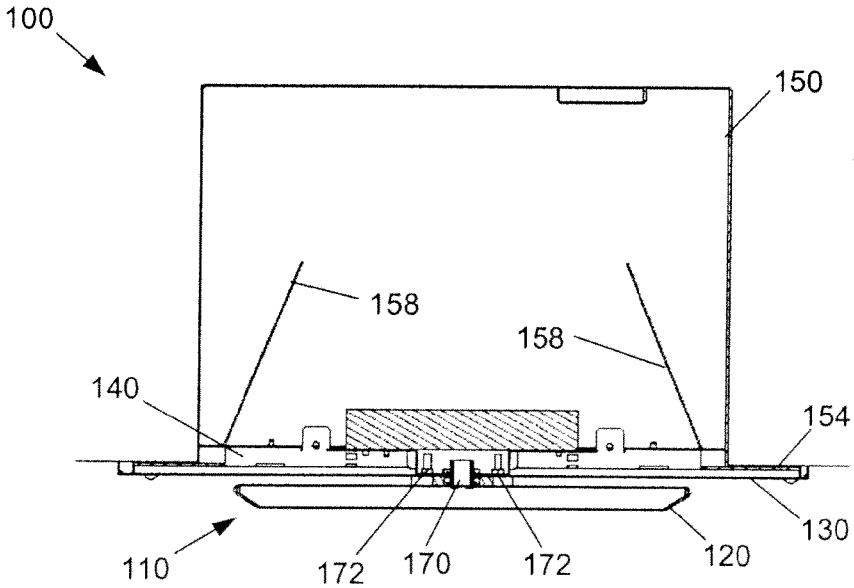
FIG. 6 depicts a further cross-section of the apparatus of FIG. 1.

The housing 150 may have a flange 152 and a canopy 154, as shown. The flange 152 may have a surface 153 projecting inward as shown. Surface 153 may be spaced apart (vertically and/or horizontally) from the canopy 154. Optional moisture shield 158 is also shown and is also depicted in FIG. 6. The depicted moisture shields 158 protect the driver from moisture dripping down from the housing 150. In an alternative embodiment (not depicted), the optional moisture shield is provided by an inverted U-shaped shield having the legs of the U mounted to the mounting panel such that the base of the U entirely covers the top-side of the driver to prevent moisture from dripping thereon, while leaving two sides of the driver (the elongated sides in one embodiment) open to air to permit cooling. The light panel 110 can be fit or connected to the housing 150 by the external mounting plate 130 and the connector plate 140. The external mounting panel 130 can be connected to the connector plate 140 by a desired number of fasteners, e.g., screws 116, as shown. The connector plate 140 includes an aperture 141 and is adapted to fit with flange 152 and/or 153 of the housing 150 and is adapted to the housing 150. The connector plate 140 includes a number of fastener structures 149, e.g., surfaces or apertures (threaded or unthreaded) for receiving screws 142 or bolts and the like. The fastener structure 149 can be located at a desired location on the connector plate 140, e.g., around an outer perimeter and in inner perimeter, as shown.

The lighting unit 120 can be of any suitable type. Exemplary embodiments can include a CRO LED 100 unit made available by LSI Industries Inc. Other suitable lighting units, and related drivers or power control units (used interchangeably herein as "drivers"), are described in co-owned U.S. patent application Ser. No. 12/582,654, filed Oct. 20, 2009 and entitled "Solid State Lighting, Driver Circuits, and Related Software," the entire contents of which are incorporated herein by reference.

When assembled, the light panel 110 can be connected to the housing 150 by way of the external mounting plate 130 and the connector plate 140. Sealant 156 may be applied, e.g., in a bead around the flange 152 and a bead on the canopy 154, to facilitate sealing of the connector plate 140 to the housing 150. Any suitable sealant may be used, e.g., RTV compounds or silicone-based compounds. A related ballast or driver (not shown) for the light panel 110 can be positioned in the opening, or aperture 141, of the connector plate 140. The connector plate 140 itself can be attached to the housing 150 by a desired number of connections/fasteners 142, e.g., six screws, with three #10 screws placed through existing self-locking sheet-metal receivers or resilient clips (e.g., so-called "Tinnerman" clips) and three self-drilling #10 screws used, as shown.

With continued reference to FIG. 1, for added safety and ease in the installation process, e.g., during a retrofit installation, a safety hook 144 (or clasp) may be present on the connector plate 140, as shown. In installation, a safety cable 146 (or tether) that is connected to the external mounting panel 130 and light panel 110 can be hung on the hook 144, allowing the connector plate 140 and housing 150 to hold the weight of the light panel 110. For example, during installation, the exterior (or, outer) mounting panel 130 that has a light unit 110 (e.g., a LED unit) and a driver mounting plate (e.g., plate 262 of FIG. 2) attached to it can be held to the connector plate 140 temporarily via a steel tether 146 and clasp 144 while the wiring portion of the installation is done. After that, the exterior mounting panel 130 can be swung into position and attached to the connector plate via fasteners, e.g., (4) #10 screws, to complete the installation. Security clips 148 may be present for securing the connector plate 140 to the housing 150, e.g., by an installer bending them over and against an inner surfaced of the housing 150. The external mounting plate 130 itself can also have features for facilitating ease (including speed) and safety of an installation process. For example, in some applications the external mounting plate 130 can have one or more keyhole slots 132 (preferably at opposite corners, as shown) allowing for quick hanging of the external mounting plate 130 and light panel 110 on the connector plate 140 and housing 150.

In exemplary embodiments, a housing, e.g., housing 150 of FIG. 1, can be a pre-existing housing, such as one used for high-intensity discharge (HID) lighting. Common types of HID housings include, but are not limited to, so-called Richmond (or "RIC") housings made available by LSI Industries Inc., so-called Whiteway Civic ("CVC") housings made available by Hubbell Lighting Inc., and Icon housings made available by Jet-Phillips Lighting. Of course, embodiments of the present disclosure can be used with any other suitable type of housing.

Figure 2:
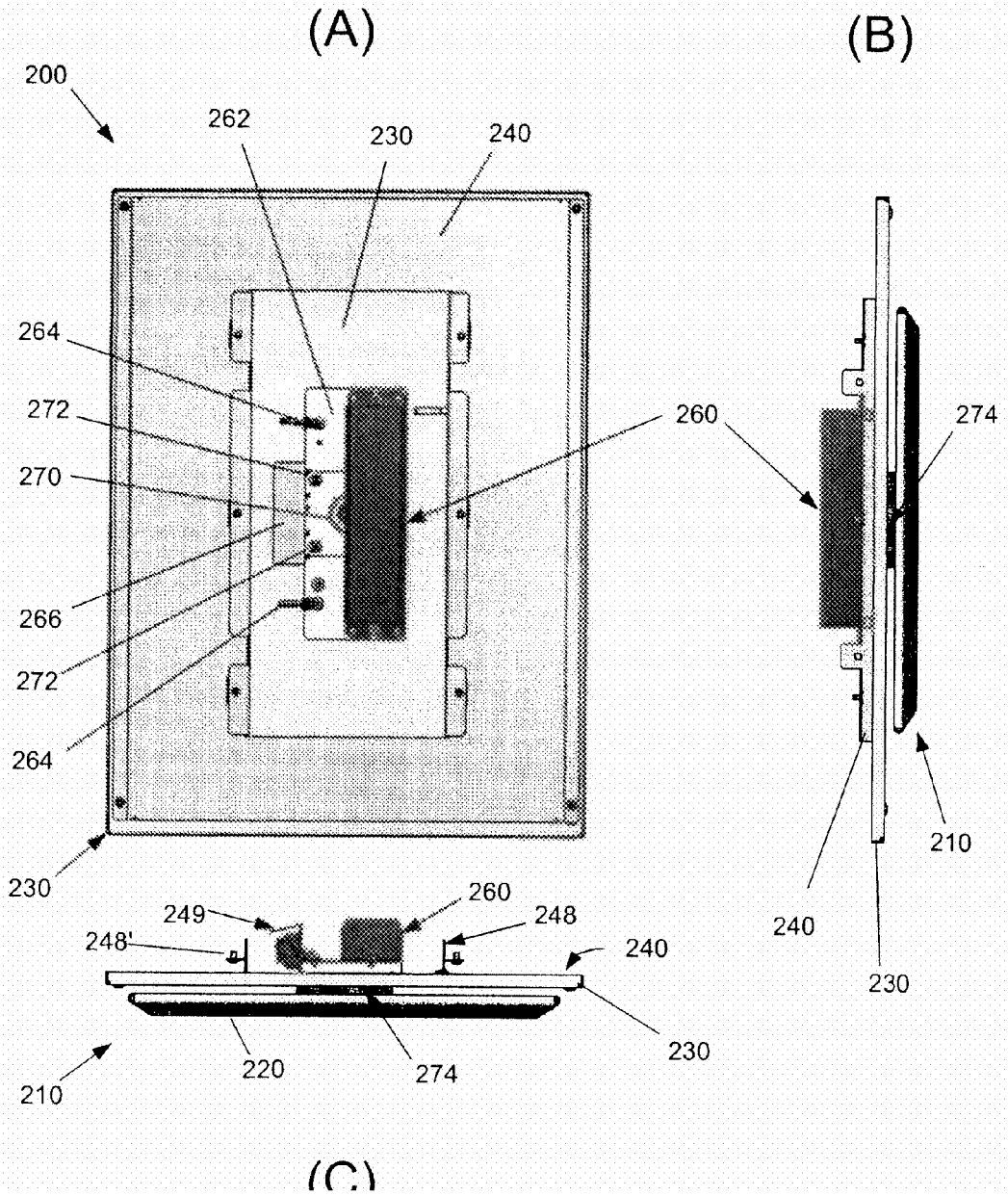
FIG. 2 includes three views (A)-(C) showing a lighting apparatus, in accordance with exemplary embodiments of the present disclosure.

FIG. 2 includes three views (A)-(C) showing a lighting apparatus assembly 200, in accordance with exemplary embodiments of the present disclosure. View (A) depicts a top view of the assembly 200, which includes a light panel 210, an external mounting panel 230, and a connector plate 240 with attached driver (power control unit) 260 and supporting driver plate 262. Views (B)-(C) depict orthogonal side views of (A), one perpendicular to the long axis and one perpendicular to the short axis of the apparatus 200.

As shown in FIG. 2, the external mounting panel 230 can be connected to the connector plate 240 and also to the light panel 210, e.g., by central threaded connection 270 and threaded connectors 272 (only two or four are shown). Central threaded connection 270 can be hollow to facilitate electrical connection between the light panel 210 and the driver 260. The driver 260 can be supported on a support surface, e.g., driver plate 262. Optional moisture shields 248 and 249 may be present. As shown in views (B) and (C), a gasket 274 may be present to provide improved sealing of the assembly 200.

FIG. 2 also shows that the connector plate 240 can include one or more tabs or flanges 248 with support surfaces adapted to mate (e.g., by way of fastener 248') with the inner surface of the related housing flange (e.g., surface 153 of FIG. 1).

Figure 3:
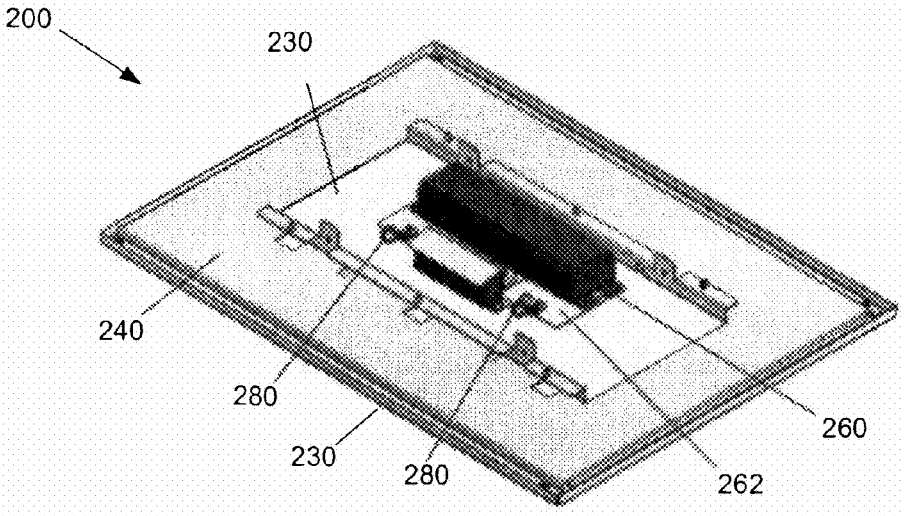
FIG. 3 depicts a perspective view of a connector plate with ballast, in accordance with exemplary embodiments of the present disclosure.

FIG. 3 depicts a perspective view of the assembly 200 of FIG. 2. The view shows the external mounting plate 230 connected to the connector plate 240 and driver plate 262. Optional ground straps 280 are also shown.

Figure 4:
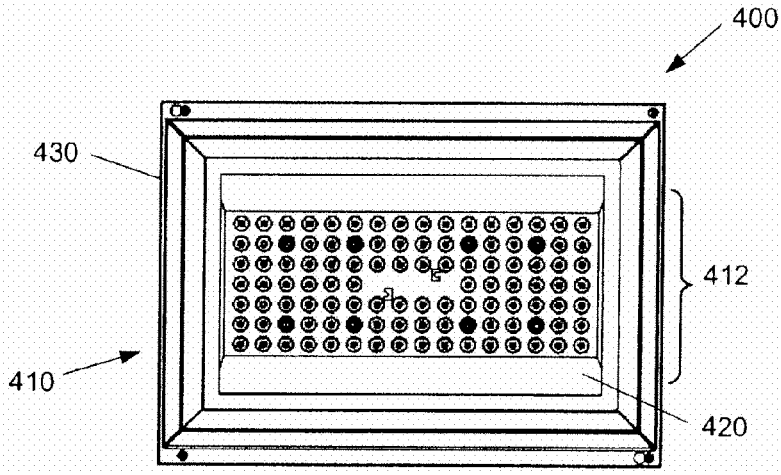
FIG. 4 depicts a plan view showing a light panel installed on an external mounting panel, in accordance with exemplary embodiments of the present disclosure.

FIG. 4 depicts a plan view showing a light panel assembly 400, in accordance with exemplary embodiments of the present disclosure. The light panel assembly 400 can include a light panel 410 that includes one or more light sources. In the drawing, light panel 410 is shown as installed on an external mounting plate 430. The light panel can include an optic 420 for protecting light sources. In exemplary embodiments, the light sources can include an array of LEDs 412, as indicated.

Figure 5:
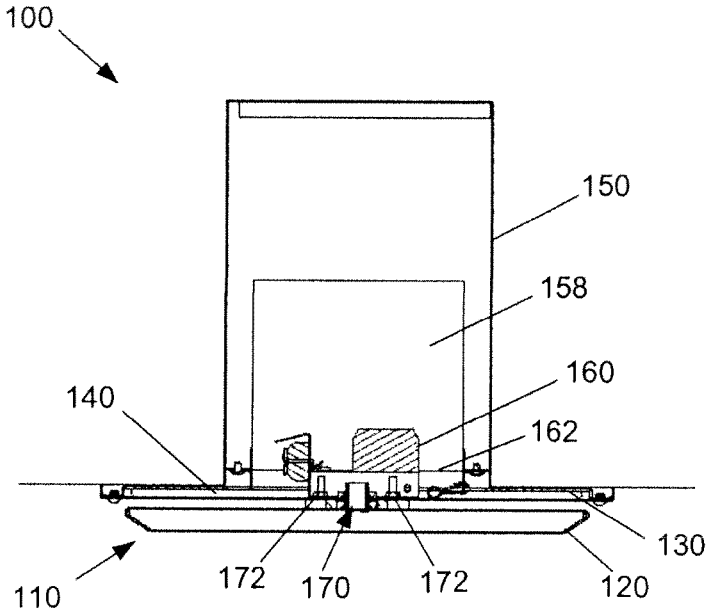
FIG. 5 depicts a cross-section of the apparatus of FIG. 1.

FIG. 5 depicts a cross-section of the apparatus 100 of FIG. 1, taken along cutting plane parallel to sides A-B of the housing canopy 154. The reference characters of FIG. 1 are used for the drawing. Threaded connections 170, 172 between the external mounting panel 130 and light panel (luminaire) 110 are shown.

FIG. 6 a further cross-section of the apparatus 100 of FIG. 1, taken along cutting plane parallel to sides C-D of the housing canopy 154. The reference character of FIG. 1 are used for the drawing.

Figure 7:
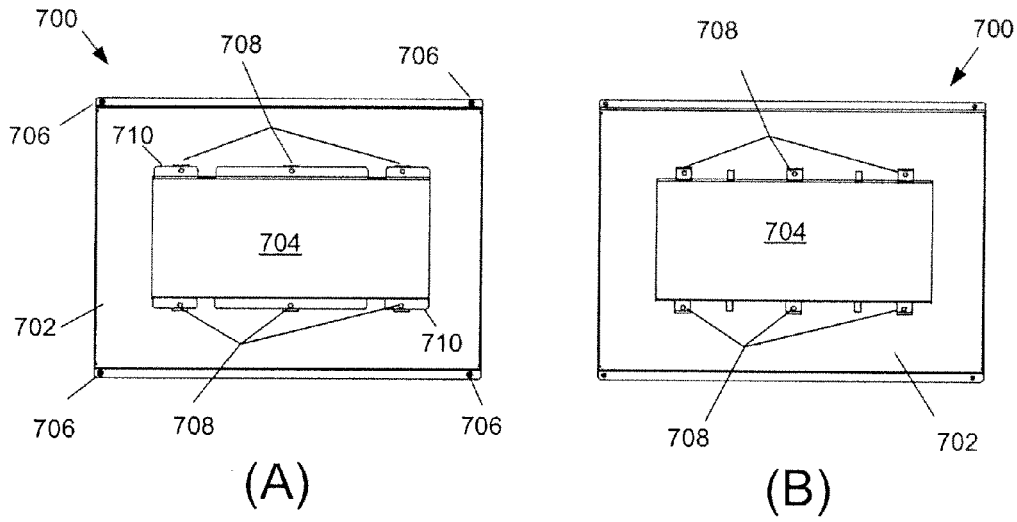
FIG. 7 includes a set of drawings (A)-(B) showing a top and bottom view of a connector plate, respectively, in accordance with an exemplary embodiment of the present disclosure.

FIG. 7 includes a set of drawings showing a top (A) and bottom (B) view of a connector plate 700, respectively, in accordance with an exemplary embodiment of the present disclosure. Connector plate 700 includes a body 702 made of a suitable material, e.g., sheet metal, and includes an opening or aperture 704. A number of fastener structures, e.g., holes 706 (threaded or non-threaded) can be located around an outer perimeter of the connector plate 700. A number of fastener structures, e.g., holes 708 (threaded or non-threaded) can be located around an inner perimeter of aperture 704. The holes, e.g., 708, can have associated surfaces or tabs. As shown in view (A), the inner perimeter of aperture 704 can have tabs or flanges that provide support surfaces 710 spaced apart from and substantially parallel to the body 702. Such surfaces 710 can be used to connect to a flange (or inner surface) of a related housing (e.g., one that the connector plate has been deigned to fit or be adapted to).

Figure 8:
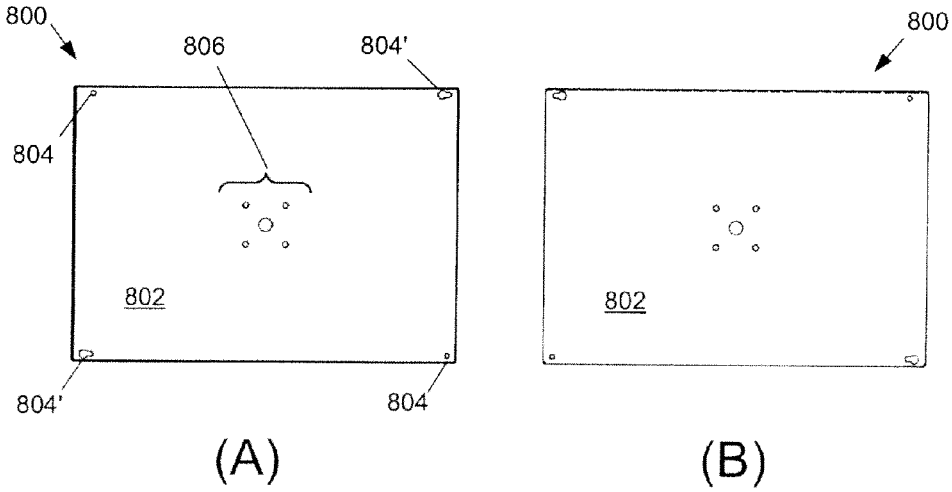
FIG. 8 includes a set of drawings (A)-(B) showing a top and bottom view, respectively, of an external mounting panel, respectively, in accordance with an exemplary embodiment of the present disclosure.

FIG. 8 includes a set of drawings showing a top (A) and bottom (B) view of an external mounting panel 800, respectively, in accordance with an exemplary embodiment of the present disclosure. The external mounting panel 800 includes a body 802 made of suitable material, e.g., sheet metal. A number of fastener holes 804 may be present to facilitate connection with a related connector plate, e.g., plate 700 of FIG. 7.

FIG. 8 also shows that keyholes 804' may be used. Such holes can allow for quick installation of the external mounting plate 800 and any attached light panel (not shown). Apertures/holes 806 can be provided to allow for connection (structural and/or electrical) of the external mounting panel to a light panel.

Figure 9:
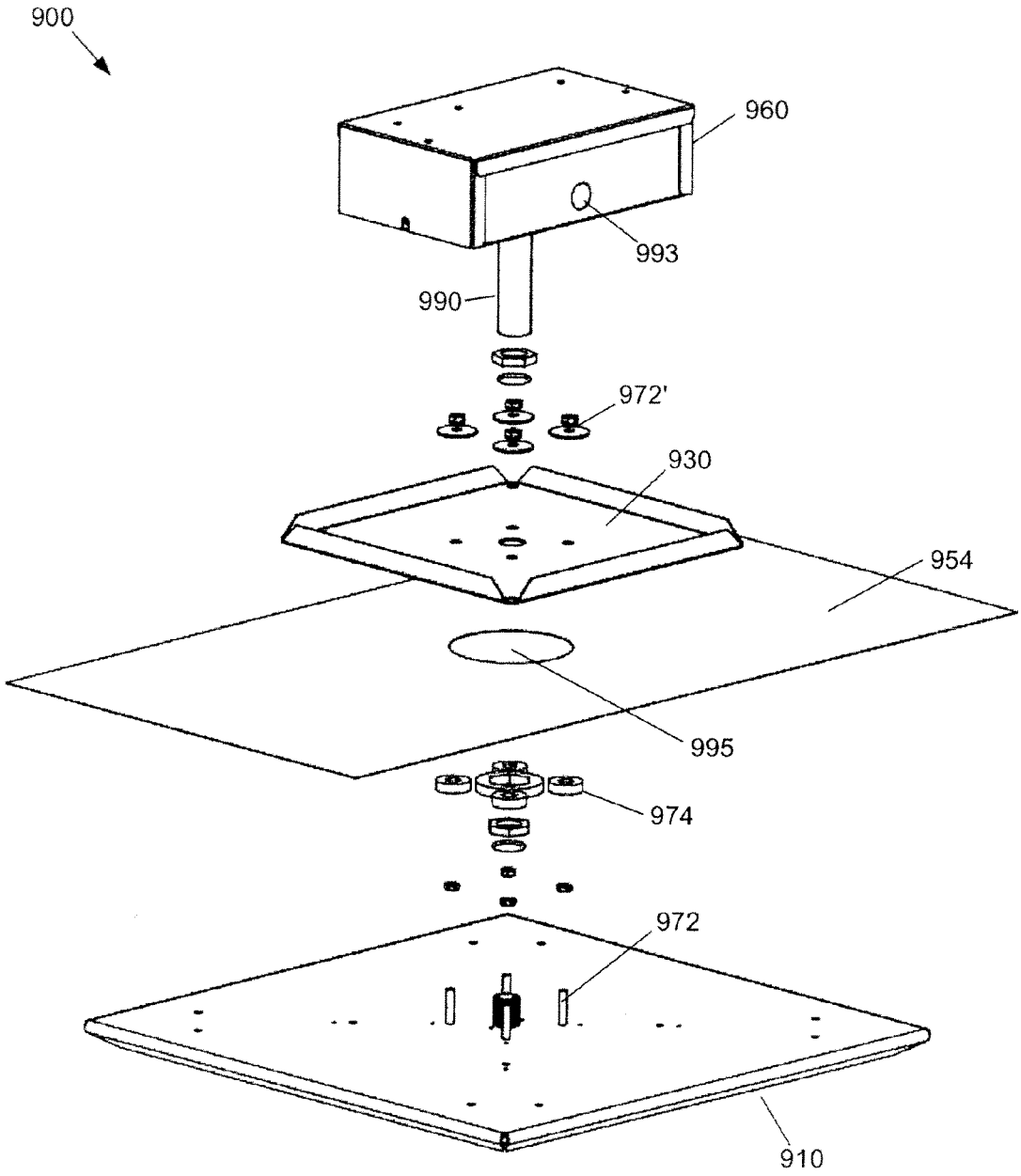
FIG. 9 depicts a perspective, exploded view of a lighting apparatus in accordance with an exemplary embodiment of the present disclosure comprising a driver box spaced from the light panel and structure to which the lighting apparatus is mounted.

FIG. 9 depicts an exploded view of a lighting apparatus 900, in accordance with exemplary embodiments of the present disclosure. The lighting apparatus 900 includes a light panel 910, an optional mounting plate 930, a driver box 960, and a driver boost 990. The light panel 910 includes a lighting unit that comprises one or more light sources. In one exemplary embodiment, the lighting unit comprises an array of commercially available LEDs, as shown in FIG. 4. The light emitted from the LEDs may optionally be directed by optics, reflectors or the like (not shown).

In one exemplary embodiment, the lighting apparatus 900 can be mounted to a canopy 954 (only a portion of which is shown for the sake of clarity) for casting light onto a petroleum refilling station, such as a typical gas station, or the like. The lighting apparatus 900 of the present disclosure is not, however, limited to the structure to which it is mounted or the environment surrounding that structure. For example, the lighting apparatus 900 may alternatively be mounted to a drop ceiling in an office or warehouse or to a soffit to light a sidewalk.

The lighting apparatus 900 depicted in FIG. 9 comprises an elevated driver box 960 elevated by driver boost 990. The mounting plate 930 is secured to the light panel 910 in a manner sandwiching the canopy 954 there between. In this depicted embodiment, fasteners 972 and 972' secure the canopy 954 to the light panel 910 using an existing hole 995 in the canopy 954 and gasket 974. A central connection 970 can be connected to the driver box 960 by way of the driver boost 990 through hole 995. The driver boost 990 can be hollow to facilitate electrical connection between the light panel 910 and the driver housed in the driver box 960. In other illustrative embodiments, the driver boost 990 can be employed with lighting apparatus not having mounting plate 930 (as in FIGS. 10A and 10B) and for mounting to structures other than a canopy.

The driver box 960 can be manufactured from formed sheet metal, molded plastic or other construction to house a driver (not depicted) to power the light sources in the light panel 910. Where the light sources are LEDs, the driver can be of the type described in copending U.S. patent application Ser. Nos. 12/112,101 and 12/582,654, the entirety of which are incorporated herein by reference. When installed in a canopy 954, the driver box 960 will be directly exposed to elements such as rain, snow, sun, etc. The driver boost 990 can be comprised of standard electrical conduit. In one embodiment, the driver boost 990 is comprised of a standard 0.5 inch trade size conduit. The driver boost 990 can, alternatively, be comprise any other appropriate construction. The driver box, conduit and all other elements of the lighting apparatus 900 should be constructed to comply with all applicable laws and ordinances.

In one optional embodiment, the driver box 960 is configured to be openable so as to provide access to the driver if and as necessary. In one example, the driver box 960 could be comprises of two sections hinged one to the other. The sections can take various forms as will be recognized by one of ordinary skill in the art. In one example, a first section comprises the bottom and the two elongated sides of the driver box 960 and the second section comprises the top and the shorter sides of the driver box 960, forming an inverted U when the driver box 960 is closed. The two sections are hinged together, in one embodiment, where the end of one of the shorter sides of the second section meets the first section, such as at the lower-right-hand corner of the driver box 960 depicted in FIG. 10A. In this optional configuration, the second section can be lifted to rotate about the hinge revealing the inside of the driver box 960 and the enclosed driver.

The driver boost 990 is connected to the driver box 960 and the light panel 910 by threaded or other connection. For example, the end of the driver boost 990 is threaded and inserted into a sheet metal knockout of the driver box 960 with a locking nut sandwiched on either side of the perimeter of the driver box knockout to lock the driver box 960 in place with respect to the driver boost 990. The driver boost 990 can be connected to the light panel 910 in a similar manner. Nuts may be pre-assembled and secured to the driver boost 990 to eliminate the need for assembly at an installation site. In one embodiment, the driver box 960 and driver boost 990 are connected to each other at the factory or elsewhere to be delivered to an installer connected one to the other with the necessary wiring extending out of the driver boost 990 for quick installation. Alternatively, the driver boost 990 could be delivered to the installer connected to the light panel 910 to facilitate quick connection of wiring extending from the driver boost 990 to the driver box 960 to complete the connection after these elements sandwich the canopy 954.

In some instances, the lighting apparatus 900 of the present disclosure may be used to replace a pre-existing lighting apparatus. A pre-existing lighting apparatus would typically have electrical wiring run to it via an electrical conduit 997, which electrical conduit 997 is positioned so as to connect with a portion of the existing apparatus. The driver box 960 of the lighting apparatus 900 of the present disclosure may be smaller than portions of the pre-existing apparatus to be replaced such that the electrical conduit 997 run to the pre-existing apparatus is not readily connectable to the lighting apparatus 900 of the present disclosure. In such instances, the driver boost 990 increases simplicity of installation and universality of the light apparatus 900 by elevating the driver box 960 so as to align a conduit hole 993 in the driver box 960 with the pre-existing conduit 997 or other facility in place for the pre-existing lighting apparatus.

The driver boost 990 can be sized at the factory for replacement of a particular, known existing lighting apparatus for which the facilities will be elevated a known measurement. Alternatively, the driver boost 990 may be adjustable to facilitate on-site sizing of the driver boost 990. In one example of adjustability, the driver boost 990 can be cut to size by an installer.

In another embodiment, the driver boost 990 of the present disclosure serves to elevate the driver box 960 from the upper surface of the canopy 954 to elevate it from standing water. Standing water can develop on the upper surface of a canopy 954 or the like creating the possibility of electrical shorts or other problems. Elevating the driver box 960 raises the driver box 960, and the electrical elements contained therein, above the surface of the canopy 954 and water standing thereon. The height of the driver box 960 can be controlled by the length of the driver boost 990 according to the depth of anticipated standing water.

Figure 10A:
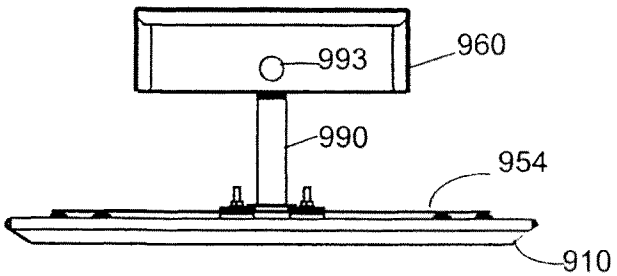
FIG. 10A depicts a left-side elevational view of the lighting apparatus of FIG. 9 without a mounting plate.
Figure 10B:
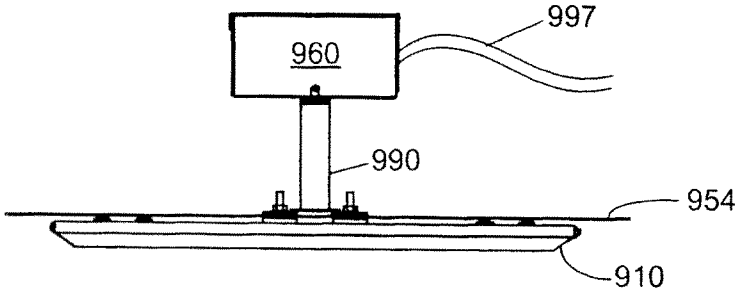
FIG. 10B depicts a front-side elevational view of the lighting apparatus of FIG. 9 without a mounting plate.

FIGS. 10A and 10B depict elevational views of the lighting apparatus of FIG. 9 without using a mounting plate 930. The mounting plate 930 is not necessary in applications in which there is no hole 995 in the canopy 954 or other structure to which the lighting apparatus 900 is to be applied. For example, the lighting apparatus of FIGS. 10A and 10B can be installed in canopy 954 without a mounting plate 930 by simply creating holes in the canopy 954 to accommodate fasteners 972 and 972' and allow the light panel 910 to be secured to the canopy 954.

Accordingly, embodiments of the present disclosure can provide benefits relative to previous techniques. For example, embodiments of the present disclosure can provide for quick and easy retrofitting of improved lighting, with light sources and power control unit, into pre-existing light housings such as HID housings.

While certain light panels have been described with particularity, others are contemplated within the scope of the present disclosure. For example, light panels or housings with adjustable light cartridges such as shown and described in co-owned U.S. application Ser. No. 12/254,104 may be used. Other suitable light panels may also be used.

When employing LEDs, one or more light boards, and more typically a printed circuit board ("PCB") may be employed. The circuitry for controlling and powering the LEDs can also be mounted on the PCB, or remotely. In one suitable embodiment, the LEDs are white LEDs each comprising a gallium nitride (GaN)-based light emitting semiconductor device coupled to a coating containing one or more phosphors. The GaN-based semiconductor device emits light in the blue and/or ultraviolet range, and excites the phosphor coating to produce longer wavelength light. The combined light output approximates a white output. For example, a GaN-based semiconductor device generating blue light can be combined with a yellow phosphor to produce white light. Alternatively, a GaN-based semiconductor device generating ultraviolet light can be combined with red, green, and blue phosphors in a ratio and arrangement that produces white light. In yet another suitable embodiment, colored LEDs are used, such are phosphide-based semiconductor devices emitting red or green light, in which case the LEDs as a group produce light of the corresponding color. In still yet another suitable embodiment, if desired, the LED light board includes red, green, and blue LEDs distributed on the PCB in a selected pattern to produce light of a selected color using a red-green-blue (RGB) color composition arrangement. In this latter exemplary embodiment, the LED light board can be configured to emit a selectable color by selective operation of the red, green, and blue LEDs at selected optical intensities.

When one or more of the light sources comprise an LED, that light source may be a unit consisting of the light-generating diode and an associated optic or the light-generating diode without the optic. When present, the associated optic can be affixed directly to the diode, can be affixed to the substrate in a position next to or in contact with the diode by separate positioning and orientation means, or located or held without the assistance of the substrate or diode. The LED can be of any kind and capacity, though in a preferred embodiment, each LED provides a wide-angle light distribution pattern. A typical LED used in the present disclosure is the wide-angle LED known herein as the bilateral, high angular LED, such as Golden DRAGON® LED manufactured by Osram Sylvania or a Nichia 083B LED. Spacing between these adjacent LED lighting assemblies may be dependent upon the angle $\alpha$ of the bilateral, high angular LED.

While aspects of the present disclosure are described herein in connection with certain embodiments, it should be noted that variations can be made by one with skill in the applicable arts within the spirit of the present disclosure. For example, while the light housings have been described herein as pre-existing, embodiments of the present disclosure can provide housings for lighting apparatus. Moreover, while fasteners have been described herein as including screws, other types of fasteners may used in place of or in addition, e.g., bolts, rivets, snap-fit connections. Further, materials used for the components and structure described herein as not limited to metal or sheet metal; for example, suitably strong plastics and/or composite materials may be used.

Various functions and elements described herein may be partitioned differently from those shown without departing from the spirit and scope of the present disclosure. Various modifications to these embodiments will be readily apparent to those skilled in the art, and generic principles defined herein may be applied to other embodiments. Thus, many changes and modifications may be made, by one having ordinary skill in the art, without departing from the spirit and scope of the present disclosure and claimed embodiments.

One skilled in the art will appreciate that embodiments and/or portions of embodiments of the present disclosure can be implemented in/with computer-readable storage media (e.g., hardware, software, firmware, or any combinations of such), and can be distributed over one or more networks. Steps described herein, including processing functions to derive, learn, or calculate formula and/or mathematical models utilized and/or produced by the embodiments of the present disclosure, can be processed by one or more suitable processors, e.g., central processing units ("CPUs), implementing suitable code/instructions in any suitable language (machine dependent on machine independent).

What is claimed is:

1. A luminaire for installation in an opening in a canopy exposed to elements and capable of collecting standing water, the luminaire comprising:

a light panel for mounting to the canopy, the light panel including one or more light sources;

a driver box for housing a driver to be electrically coupled to at least one of the one or more light sources, the driver box for being located over the light panel;

a boost between the light panel and the driver box spacing the driver box above the light pane define a distance between the light panel and the driver box sufficient to keep the driver box out of standing water when standing water collects immediately beneath the driver box on the canopy; and the boost having a threaded end for insertion into the driver box to facilitate connection of the boost to the driver box.

2. The luminaire of claim 1, wherein the distance places the driver box in communication with facilities on the canopy.

3. The luminaire of claim 1, wherein the canopy is a gasoline service station canopy.

4. The luminaire of claim 1, wherein the boost facilitates placing the driver box in electrical communication with the facilities.

5. The luminaire of claim 1, wherein the boost facilitates placing the driver box in electrical communication with the facilities previously installed for communication with a different lighting apparatus.

6. The luminaire of claim 1, wherein at least one of the one or more light sources comprises an LED.

7. The luminaire of claim 1, wherein the at least one dimension of the boost is adjustable.

8. The luminaire claim 1, wherein the at least one adjustable dimension of the boost is a length of the boost.

9. The luminaire claim 1, wherein the length of the boost is adjustable by cutting the boost.

10. The luminaire of claim 1 further comprising a mounting plate.

11. A canopy with a luminaire, the luminaire comprising:
a light panel including one or more light sources;
a driver box housing a driver electrically coupled to at least one of the one or more light sources;
a boost between the light panel and the driver box spacing the driver box above the light panel to define a distance between the light panel and the driver box sufficient to keep the driver box out of standing water when standing water collects immediately beneath the driver box on the canopy; and
the boost having a threaded end for insertion into the driver box to facilitate connection of the boost to the driver box.

12. The luminaire of claim 11, wherein the canopy is a gasoline service station canopy.

13. The luminaire of claim 11, wherein at least one of the one or more light sources comprises an LED.

14. The luminaire of claim 11 further comprising a mounting plate.

15. A luminaire for installation in an opening in a canopy exposed to elements and capable of collecting standing water, the luminaire comprising:
a light panel for mounting to the canopy, the light panel including one or more light sources;
a driver box for housing a driver to be electrically coupled to at least one of the one or more light sources, the driver box for being located over the light panel; and
a boost between the light panel and the driver box spacing the driver box above the light panel to define a distance between the light panel and the driver box sufficient to keep the driver box out of standing water when standing water collects immediately beneath the driver box on the canopy;
wherein the boost is hollow to facilitate electrical connection between the light panel and the driver box and the boost having a threaded end for insertion into the driver box to facilitate connection of the boost to the driver box.

16. The luminaire of claim 15, wherein the distance places the driver box in communication with facilities on the canopy.

17. The luminaire of claim 15, wherein the canopy is a gasoline service station canopy.

18. The luminaire of claim 15, wherein the boost facilitates placing the driver box in electrical communication with the facilities.

19. The luminaire of claim 15, wherein the boost facilitates placing the driver box in electrical communication with the facilities previously installed for communication with a different lighting apparatus.

20. The luminaire of claim 15, wherein at least one of the one or more light sources comprises an LED.

21. The luminaire of claim 15, wherein the boost is adjustable.

22. The luminaire of claim 15, wherein the boost defines a length that is adjustable.

23. The luminaire of claim 15, wherein the boost defines a length that is adjustable by cutting the boost.

24. The luminaire of claim 15 further comprising a mounting plate.

25. A canopy with a luminaire, the luminaire comprising:
a light panel including one or more light sources;
a driver box housing a driver electrically coupled to at least one of the one or more light sources; and
a boost between the light panel and the driver box spacing the driver box above the light panel to define a distance between the light panel and the driver box sufficient to keep the driver box out of standing water when standing water collects immediately beneath the driver box on the canopy;
wherein the boost is hollow to facilitate electrical connection between the light panel and the driver box and the boost having a threaded end for insertion into the driver box to facilitate connection of the boost to the driver box.

26. The luminaire of claim 25, wherein the canopy is a gasoline service station canopy.

27. The luminaire of claim 25, wherein at least one of the one or more light sources comprises an LED.

28. The luminaire of claim 25 further comprising a mounting plate.

29. A luminaire for installation in an opening in a canopy exposed to elements and capable of collecting standing water, the luminaire comprising:
a light panel for mounting to the canopy, the light panel including one or more light sources;
a driver box for housing a driver to be electrically coupled to at least one of the one or more light sources, the driver box for being located over the light panel; and
a boost between the light panel and the driver box spacing the driver box above the light panel to define a distance between the light panel and the driver box sufficient to keep the driver box out of standing water when standing water collects immediately beneath the driver box on the canopy;
wherein the end of the boost is threaded for insertion into the driver box to facilitate connection of the boost to the driver box and the driver box is mounted on and supported only by the boost.

30. The luminaire of claim 29, wherein the distance places the driver box in communication with facilities on the canopy.

31. The luminaire of claim 29, wherein the canopy is a gasoline service station canopy.

32. The luminaire of claim 29, wherein the boost facilitates placing the driver box in electrical communication with the facilities.

33. The luminaire of claim 29, wherein the boost facilitates placing the driver box in electrical communication with the facilities previously installed for communication with a different lighting apparatus.

34. The luminaire of claim 29, wherein at least one of the one or more light sources comprises an LED.

35. The luminaire of claim 29, wherein the boost is adjustable.

36. The luminaire of claim 29, wherein the boost defines a length that is adjustable.

37. The luminaire of claim 29, wherein the boost defines a length that is adjustable by cutting the boost.

38. The luminaire of claim 29 further comprising a mounting plate.

39. A canopy with a luminaire, the luminaire comprising:
a light panel including one or more light sources;
a driver box housing a driver electrically coupled to at least one of the one or more light sources; and
a boost between the light panel and the driver box spacing the driver box above the light panel to define a distance between the light panel and the driver box sufficient to keep the driver box out of standing water when standing water collects immediately beneath the driver box on the canopy;

wherein the end of the boost is threaded for insertion into the driver box to facilitate connection of the boost to the driver box and the driver box is mounted on and supported only by the boost.

40. The luminaire of claim 39, wherein the canopy is a gasoline service station canopy.

41. The luminaire of claim 39, wherein at least one of the one or more light sources comprises an LED.

42. The luminaire of claim 39 further comprising a mounting plate.

* * * * *

UNITED STATES PATENT AND TRADEMARK OFFICE

CERTIFICATE OF CORRECTION

PATENT NO. : 8,608,335 B2
APPLICATION NO. : 13/754601
DATED : December 17, 2013
INVENTOR(S) : Rob Allen Rooms et al.

It is certified that error appears in the above-identified patent and that said Letters Patent is hereby corrected as shown below:

In the Specification

1. At column 2, line 16, after "discharge" delete "D" and insert: --(HID)--

In the Claims

2. At column 10, line 50, after "the light" delete "pane" and insert: --panel to--

3. At column 11, line 5, after "luminaire" insert: --of--

4. At column 11, line 7, after "luminaire" insert: --of--

Signed and Sealed this
Twenty-fifth Day of March, 2014

Michelle K. Lee

Michelle K. Lee
*Deputy Director of the United States Patent and Trademark Office*